US007252566B2

(12) United States Patent
Kamio et al.

(10) Patent No.: US 7,252,566 B2
(45) Date of Patent: Aug. 7, 2007

(54) MOUNTING PORTION OF WATER JET PUMP OF PERSONAL WATERCRAFT, AND PERSONAL WATERCRAFT

(75) Inventors: Kunihiko Kamio, Kobe (JP); Takahide Komoriya, Kakogawa (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 10 days.

(21) Appl. No.: 11/198,890

(22) Filed: Aug. 4, 2005

(65) Prior Publication Data

US 2006/0040571 A1 Feb. 23, 2006

(30) Foreign Application Priority Data

Aug. 9, 2004 (JP) ..... 2004-232201

(51) Int. Cl.
*B63H 11/00* (2006.01)

(52) U.S. Cl. ..... 440/38

(58) Field of Classification Search ..... None
See application file for complete search history.

(56) References Cited

U.S. PATENT DOCUMENTS 5,310,368 A * 5/1994 Kamitake ..... 440/38
6,176,749 B1 * 1/2001 Kato ..... 440/38
6,231,409 B1 * 5/2001 Kato ..... 440/38

FOREIGN PATENT DOCUMENTS

JP 2002-308183 10/2002
JP 2004-308183 11/2004

* cited by examiner

*Primary Examiner*—Lars A. Olson
*Assistant Examiner*—Daniel V. Venne
(74) *Attorney, Agent, or Firm*—Alleman Hall McCoy Russell & Tuttle LLP

(57) ABSTRACT

A mounting portion of a water jet pump of a personal watercraft is disclosed. The mounting portion typically includes a tubular pump casing configured to accommodate the impeller, and a pump bracket configured to fasten the pump casing to the body of the watercraft. The pump casing is configured to be mountable to the pump bracket in such a manner that an internal fitting portion of the pump casing is internally fitted to a casing receiving portion of the pump bracket from rearward with a ring-shaped seal element fitted into a groove provided on the pump casing, and an outer peripheral surface of the internal fitting portion and an inner peripheral surface of the casing receiving portion are sealed by the seal element.

5 Claims, 7 Drawing Sheets

MOUNTING PORTION OF WATER JET PUMP OF PERSONAL WATERCRAFT, AND PERSONAL WATERCRAFT

BACKGROUND OF THE INVENTION

1. Field of the Invention

The present invention generally relates to a mounting portion of a water jet pump of a personal watercraft, and a personal watercraft. More particularly, the present invention relates to a mounting portion including a pump casing and a pump bracket configured to fasten the pump casing to a body of a personal watercraft, and a personal watercraft comprising the mounting portion.

2. Description of the Related Art

In recent years, water-jet propulsion personal watercraft have been widely used in leisure, sport, rescue activities, and the like. A typical personal watercraft comprises a body including a hull and a deck covering the hull from above, and is equipped with an engine in a space inside the body. A water jet pump is equipped in a pump room formed on a rear bottom portion of the body. The water jet pump is configured to be driven to propel the watercraft. Specifically, a water intake is provided at a rearward position of a hull bottom surface, and a water intake passage extends rearward from the water intake to the water jet pump equipped in the pump room. Furthermore, a rear portion of the water passage is coupled to a pump bracket fastened to a front wall of the pump room. A pump casing that accommodates an impeller is mounted to the pump bracket from rearward, and a pump nozzle is connected to the rear portion of the pump casing.

A propeller shaft is coupled to a crankshaft of the engine. The propeller shaft extends rearward and is coupled to a pump shaft disposed within the pump casing. The impeller is attached on the pump shaft. When the engine operates, the impeller within the pump casing rotates integrally with the crankshaft. Water is sucked though the water intake from outside. The water is pressurized and accelerated by the rotation of the impeller, and is ejected rearward from the pump nozzle. As a result, the personal watercraft is propelled.

There are a variety of mounting portions including the pump casing and the pump bracket configured to fasten the pump casing to the body of the watercraft. One exemplary mounting portion is disclosed in Japanese Laid-Open Patent Application Publication No. 2002-308183, in which a diagonal-flow type pump casing with an inner diameter that increases rearward is mounted to a pump bracket. In this mounting portion, a seal element for exclusive use is provided between the pump casing and the pump bracket. The seal element serves to inhibit reduction of pumping efficiency, which may be caused by air flowing from the pump room side of the hull into the pump casing. The seal element is made of flexible rubber having a relatively large thickness. The seal element is provided to cover substantially the entire of an outer peripheral surface and a front end surface of a front end portion of the substantially tubular pump casing. The pump casing is mounted to the pump bracket in a sealed condition, regardless of some displacement between the pump casing and the pump bracket in a mounting operation, in such a manner that the pump casing with the seal element is inserted into the pump bracket from rearward.

However, in the mounting portion disclosed in the above Patent Publication No. 2002-308183, it is necessary to manufacture a seal element for exclusive use having a unique shape according to outer dimensions of the pump casing and the pump bracket. Furthermore, since a contact area between the seal element provided to cover the pump casing and the pump bracket is large, the seal element may be displaced or deformed by contact with the pump bracket in the mounting operation.

SUMMARY OF THE INVENTION

The present invention addresses the above described condition, and an object of the present invention is to provide a mounting portion of a water jet pump of a personal watercraft, which includes a pump casing and a pump bracket configured to fasten the pump casing to a body of the watercraft using a seal element of a simple shape without substantial displacement of the seal element. Another object of the present invention is to provide a personal watercraft comprising the mounting portion of the water jet pump.

According to one aspect of the present invention, there is provided a mounting portion of a water jet pump of a personal watercraft, the water jet pump including an impeller that rotates to eject water taken in from a bottom of a body of the watercraft rearward to thereby propel the watercraft, the mounting portion comprising a tubular pump casing configured to accommodate the impeller, and a pump bracket configured to fasten the pump casing to the body of the watercraft. The pump casing includes an internal fitting portion in a front portion thereof, and the internal fitting portion is provided on an outer peripheral surface thereof with a groove extending in a circumferential direction of the internal fitting portion and is configured to be internally fitted into the pump bracket. The pump bracket includes a casing receiving portion in a rear portion thereof and is configured to be externally fitted to the internal fitting portion of the pump casing. The pump casing is configured to be mountable to the pump bracket in such a manner that the internal fitting portion is internally fitted to the casing receiving portion of the pump bracket from rearward with a ring-shaped seal element fitted into the groove, and an outer peripheral surface of the internal fitting portion and an inner peripheral surface of the casing receiving portion are sealed by the seal element.

In such a construction, the seal element of a simple shape, for example, an O-ring, which is a standard product (commercially available product), is fitted to the groove formed on the internal fitting portion of the pump casing, and the pump casing and the pump bracket are sealed when mounting the pump casing to the pump bracket. The seal element fitted into the groove is less likely to be displaced by contact with the pump bracket in a mounting operation.

The internal fitting portion of the pump casing may have an outer diameter that decreases forward, and the casing receiving portion of the pump bracket may have an inner diameter that increases rearward so as to conform in shape to the outer peripheral surface of the internal fitting portion.

In such a construction, the internal fitting portion of the pump casing has an outer diameter that decreases forward, i.e., toward the pump bracket to form a taper shape, while the casing receiving portion of the pump bracket has an inner diameter that increases rearward, i.e., toward the pump casing to form a taper shape. As a result, the internal fitting portion of the pump casing is easily mounted to the casing receiving portion of the pump bracket.

The groove may be one of a plurality of grooves provided coaxially on the outer peripheral surface of the internal fitting portion of the pump casing. In such a construction, the sealing between the pump casing and the pump bracket is improved.

The water jet pump may be of an axial-flow type in which the pump casing has a substantially constant inner diameter in an axial direction of the water jet pump.

According to another aspect of the present invention, there is provided a water-jet propulsion personal watercraft comprising a body including a hull having a water intake and a deck covering the hull from above, a water jet pump mounted in a pump room formed on a rear bottom portion of the hull and including an impeller that rotates to eject water taken in from the water intake to thereby propel the watercraft, a water intake passage through which water is guided from the water intake to the water jet pump, a tubular pump casing configured to accommodate the impeller, and a pump bracket configured to fasten the pump casing to the body and to couple the water intake passage to the pump casing with the pump casing fastened to the body. The pump casing includes an internal fitting portion in a front portion thereof, and the internal fitting portion is provided on an outer peripheral surface thereof with a groove extending in a circumferential direction of the internal fitting portion and is configured to be internally fitted to the pump bracket. The pump bracket includes a casing receiving portion in a rear portion thereof and is configured to be externally fitted to the internal fitting portion of the pump casing. The pump casing is configured to be mountable to the pump bracket in such a manner that the internal fitting portion is internally fitted to the casing receiving portion of the pump bracket from rearward with a ring-shaped seal element fitted into the groove, and an outer peripheral surface of the internal fitting portion and an inner peripheral surface of the casing receiving portion are sealed by the seal element.

In such a construction, the water jet pump is easily assembled and the pump casing and the pump bracket are reliably sealed.

The above and further objects and features of the invention will more fully be apparent from the following detailed description with accompanying drawings.

DETAILED DESCRIPTION OF THE PREFERRED EMBODIMENTS

Figure 1:
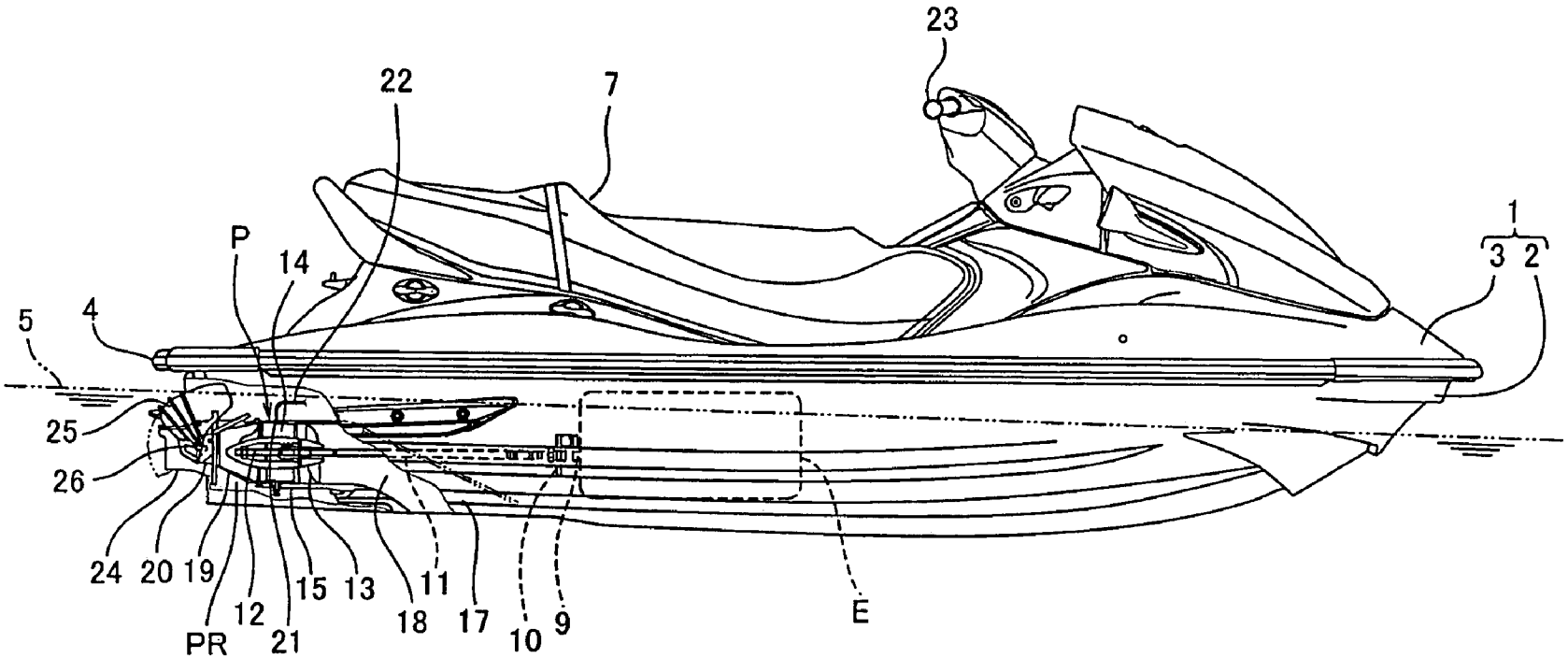
FIG. 1 is a side view of a personal watercraft according to an embodiment of the present invention.

Hereinafter, an embodiment of a mounting portion of a water jet pump of a personal watercraft of the present invention will be described with reference to the accompanying drawings. A personal watercraft of FIG. 1 is a straddle-type personal watercraft equipped with a seat 7 straddled by a rider. A body 1 of the watercraft includes a hull 2 and a deck 3 covering the hull 2 from above. A line at which the hull 2 and the deck 3 are connected over the entire perimeter thereof is called a gunnel line 4. In FIG. 1, the gunnel line 4 is located above a waterline 5 of the personal watercraft.

Figure 2:
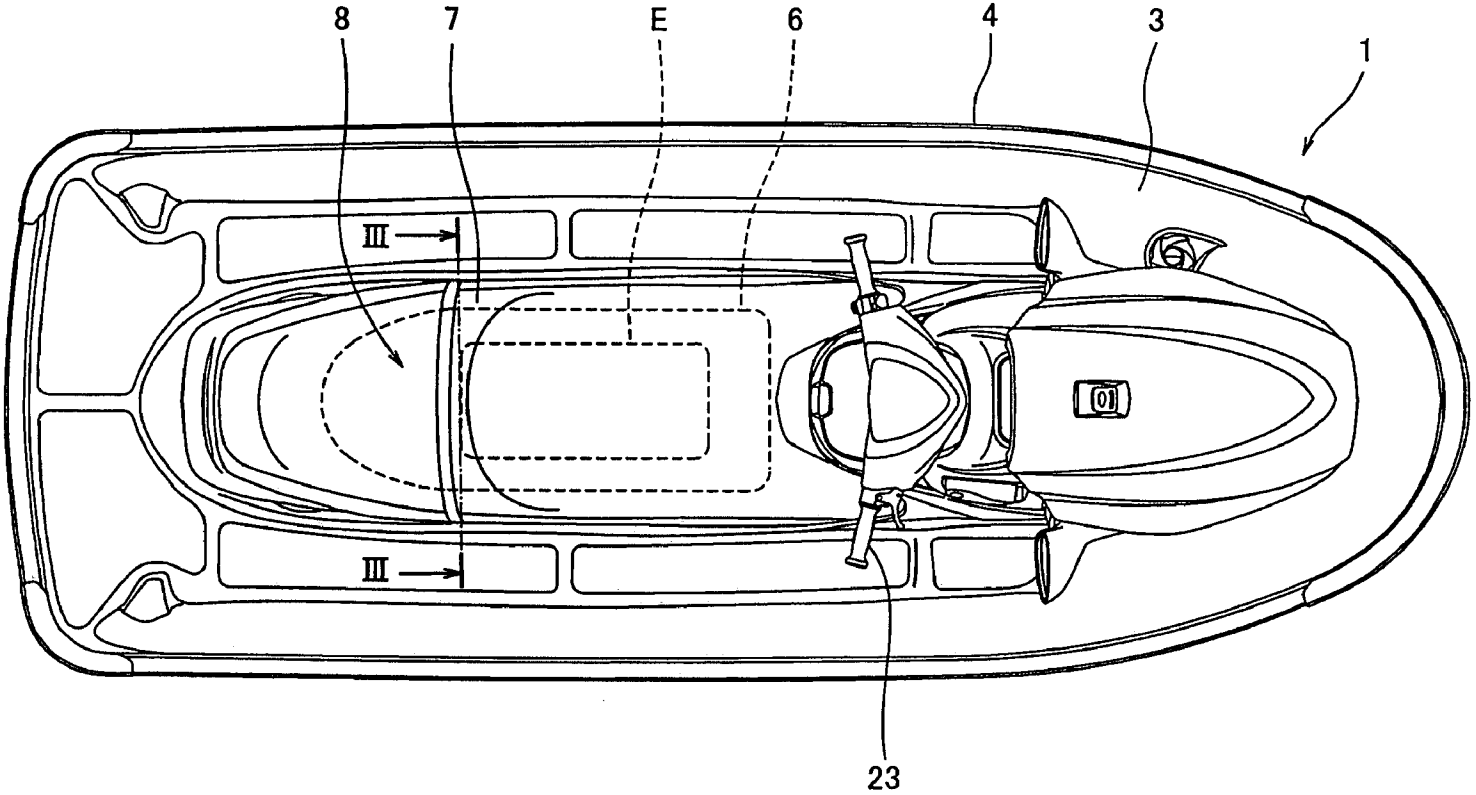
FIG. 2 is a plan view of the personal watercraft of FIG. 1.

As shown in FIG. 2, a deck opening 6, which has a substantially rectangular shape as seen from above is formed at a substantially center section of the deck 3 in the upper portion of the body 1 such that its longitudinal direction corresponds with the longitudinal direction of the body 1. The seat 7 is removably mounted over the deck opening 6. An engine room 8 is provided in a space defined by the hull 2 and the deck 3 below the deck opening 6. The engine room 8 has a convex-shaped transverse cross-section and is configured such that its upper portion is smaller than its lower portion. An engine E is mounted within the engine room 8 and is configured to drive the watercraft. In this embodiment, the engine E is an in-line four-cylinder four-cycle engine. As shown in FIG. 1, the engine E is mounted such that a crankshaft 9 extends along the longitudinal direction of the body 1.

As shown in FIG. 1, an output end of the crankshaft 9 is coupled to a propeller shaft 11 through a coupling device 10. The propeller shaft 11 is coupled to a pump shaft 12 of a water jet pump P mounted in a pump room PR formed on a rear bottom portion of the body 1. The pump shaft 12 is configured to rotate integrally with the crankshaft 9. An impeller 13 is attached on the pump shaft 12. Fairing vanes 14 are provided behind the impeller 13. The impeller 13 is covered with a tubular pump casing 15 on the outer periphery thereof.

A water intake 17 is provided on the bottom of the hull 2. The water intake 17 is connected to the pump casing 15 by a water intake passage 18 and a pump bracket 32 (FIG. 3) described later. The pump casing 15 is in turn connected to a pump nozzle 19 provided on the rear side of the body 1. The pump nozzle 19 has a cross-sectional area that gradually reduces rearward, and an outlet port 20 is provided on the rear end of the pump nozzle 19.

In the above constructed personal watercraft, water outside the watercraft is sucked from the water intake 17 provided on the bottom of the hull 2 and is fed to the water jet pump P. The water jet pump P pressurizes and accelerates the water, and the fairing vanes 14 guide water flow behind the impeller 13. The water is ejected through the pump nozzle 19 and from the outlet port 20. As the resulting reaction, the watercraft obtains a propulsion force.

The engine E employs an open-looped cooling system configured to directly cool the engine E and the associated components using the water taken in from outside for use as the cooling water. As shown in FIG. 1, a water-drawing hole 21 is provided at a predetermined position in an upper portion of the pump casing 15. The water that has been pressurized by the water jet pump P is drawn up into the body 1 through the water-drawing hole 21 and a cooling water pipe 22 and is used as the cooling water to cool the engine E and the associated components.

A bar-type steering handle 23 is provided on the deck 3 to be located in front of the seat 7. The handle 23 is connected to a steering nozzle 24 provided behind the pump nozzle. 19 through a cable (not shown). When the rider rotates the handle 23 clockwise or counterclockwise, the steering nozzle 24 pivots toward the opposite direction so that the ejection direction of the water being ejected through the pump nozzle 19 can be changed, and the watercraft can be correspondingly turned to any desired direction while the water jet pump P is generating the propulsion force.

As shown in FIG. 1, a bowl-shaped reverse deflector 25 is provided on the rear side of the body 1 and on an upper portion of the steering nozzle 24 such that it is vertically pivotable around a pivot shaft 26 that is oriented horizontally. When the deflector 25 is pivoted downward around the pivot shaft 26 to be positioned behind the steering nozzle 24, the water ejected rearward from the steering nozzle 24 collides against an inner surface of the deflector 25 and is thereby directed substantially forward. Thereby, the watercraft is propelled rearward.

Figure 3:
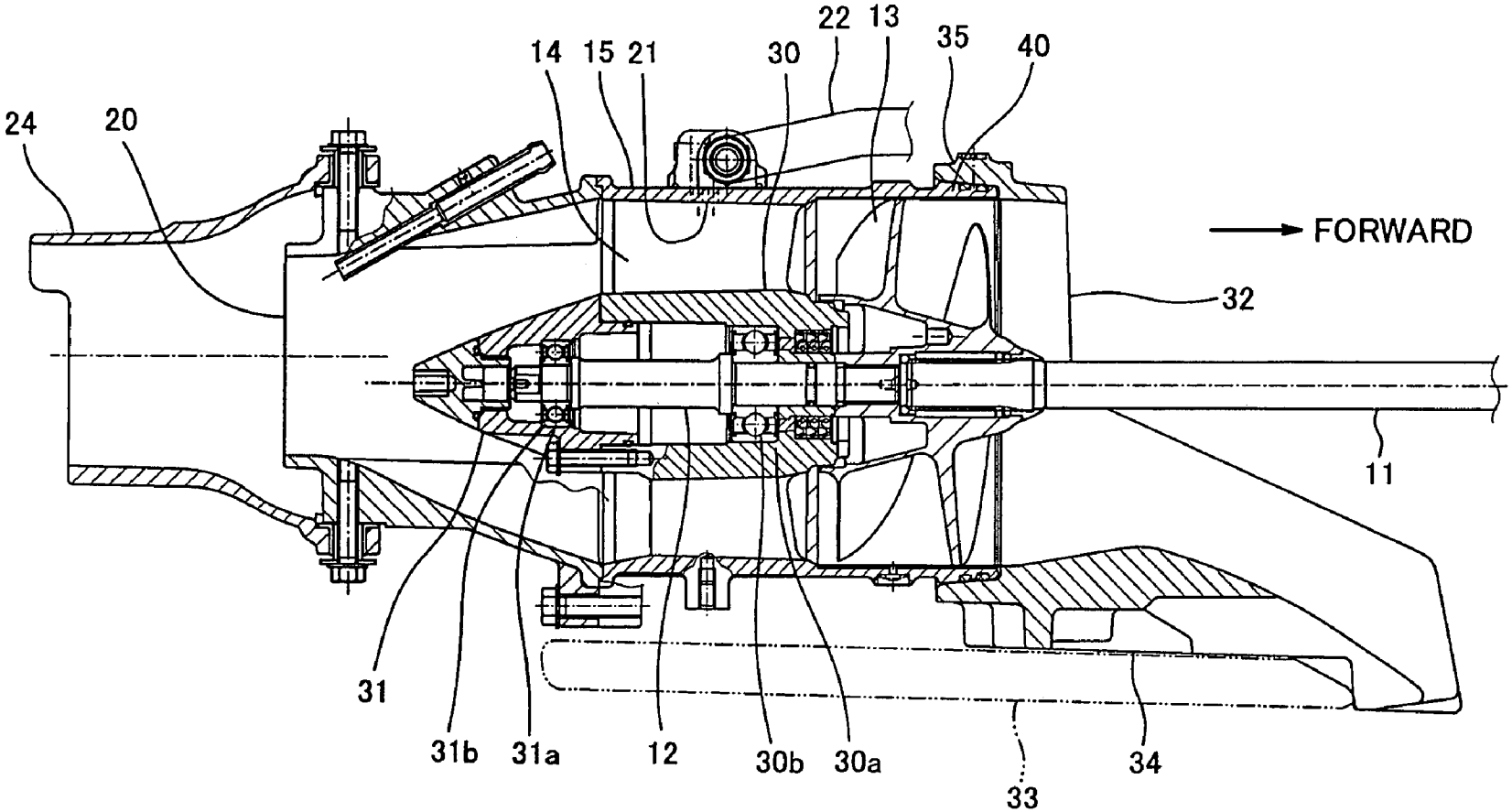
FIG. 3 is an enlarged cross-sectional view showing a construction of a water jet pump of FIG. 1.

The construction of the water jet pump P will be described with reference to FIG. 3. As shown in FIG. 3, the water jet pump P of this embodiment is an axial-flow type in which the tubular pump casing 15 has a substantially constant inner diameter in an axial direction thereof. Within the pump casing 15, a base portion 30 that is barrel-shaped and has a hollow inner space is provided concentrically with the pump casing 15. The fairing vane 14 is plate-shaped and is provided between an outer wall portion of the base portion 30 and an inner wall portion of the pump casing 15 to connect them. The pump casing 15, the base portion 30, and the fairing vane 14 are integral with each other.

A bearing housing 30*a* is formed in a front portion inside the base portion 30. A ball bearing 30*b* is mounted within the bearing housing 30*a*. A fairing cone. 31 with a diameter that decreases rearward is coupled to a rear portion of the base portion 30, and a ball bearing 31*b* is mounted within a bearing housing 31*a* formed inside the cone 31. The pump shaft 12 is pivotally supported at two locations by the ball bearings 30*b* and 31*b* positioned forward and rearward. The impeller 13 is mounted to a front end portion of the pump shaft 12 to be rotatable integrally with the pump shaft 12.

A pump bracket 32 is positioned in front of the pump casing 15. The pump casing 15 is mounted to the pump bracket 32. The pump bracket 32 includes a base 34 fastened to a pump cover 33 (indicated by two-dotted line) covering the water jet pump P from below. The pump bracket 32 is fastened to a front wall of the pump room PR formed on the hull 2 (FIG. 1) in such a manner that the water intake passage 18 (FIG. 1) is connected to a front portion of the pump bracket 32, and the pump casing 15 is mounted to a rear portion of the pump bracket 32, thereby forming a water passage extending from the water intake 17 (FIG. 1) on the bottom of the hull 2 to the pump casing 15. The pump cover 33 is fastened to the base 34 of the pump bracket 32 (FIG. 2).

Figure 4:
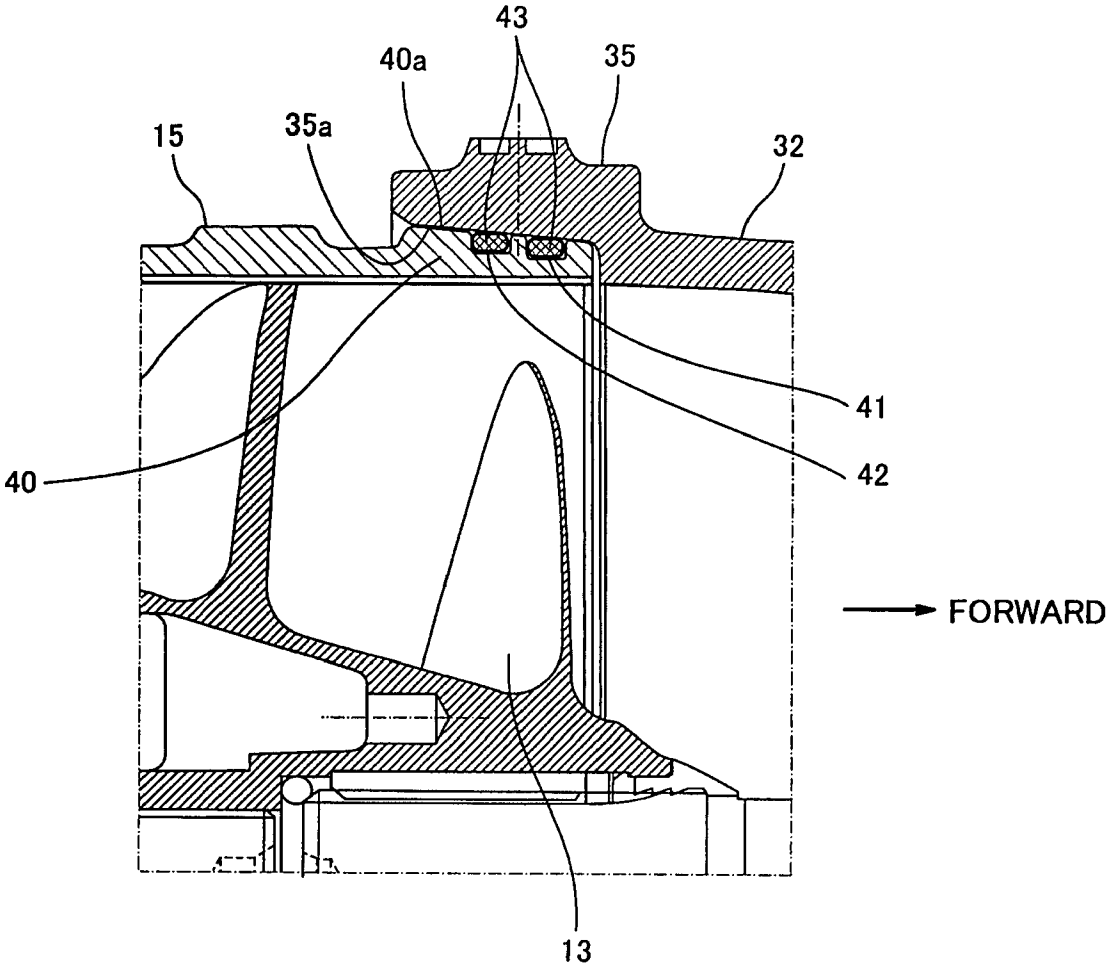
FIG. 4 is a partially enlarged cross-sectional view showing a mounting portion including a pump casing of the water jet pump of FIG. 3 and a pump bracket configured to fasten the pump casing to a body of the watercraft.

FIG. 4 is a partial enlarged cross-sectional view showing the mounting portion including the pump casing 15 and the pump bracket 32 configured to fasten the pump casing 15 to the body 1 of the watercraft. As shown in FIGS. 3 and 4, the front end portion of the pump casing 15 forms an internal fitting portion 40 having a tapered outer peripheral surface 40*a* with an outer diameter that decreases forward. Grooves 41 and 42 are formed on the outer peripheral surface 40*a* of the internal fitting portion 40 so as to extend in a circumferential direction thereof. The grooves 41 and 42 are provided coaxially with each other. Each groove 41,42 has a rectangular cross-section in which its width is larger than its depth. Ring-shaped seal elements 43 are fitted into the grooves 41 and 42, respectively. The pump bracket 32 has a case receiving portion 35 which opens in the longitudinal direction of the body 1. The casing receiving portion 35 of the pump bracket 32 has an inner peripheral surface 35*a* with an inner diameter that increases rearward. The inner peripheral surface 35*a* of the casing receiving portion 35 substantially conforms in shape to the outer peripheral surface 40*a* of the internal fitting portion 40 of the pump casing 15.

The seal elements 43 fitted into the grooves 41 and 42 may be commercially available standard products such as O-rings or square rings. In this embodiment, O-rings that have circular cross-sections with a diameter larger than a depth of the grooves 41 and 42 are used. The O-rings having such a structure, i.e., the seal elements 43, protrude from the outer peripheral surface 40*a* of the internal fitting portion 40 with the seal elements 43 fitted into the grooves 41 and 42. So, when the internal fitting portion 40 is inserted into the casing receiving portion 35, the seal elements 43 are pressed by the inner peripheral surface 35*a* of the casing receiving portion 35 and thereby are elastically deformed, causing the internal fitting portion 40 and the casing receiving portion 35 to be sealed. The shape of the cross-section of the grooves 41 may alternatively be semi-circular.

Figure 5:
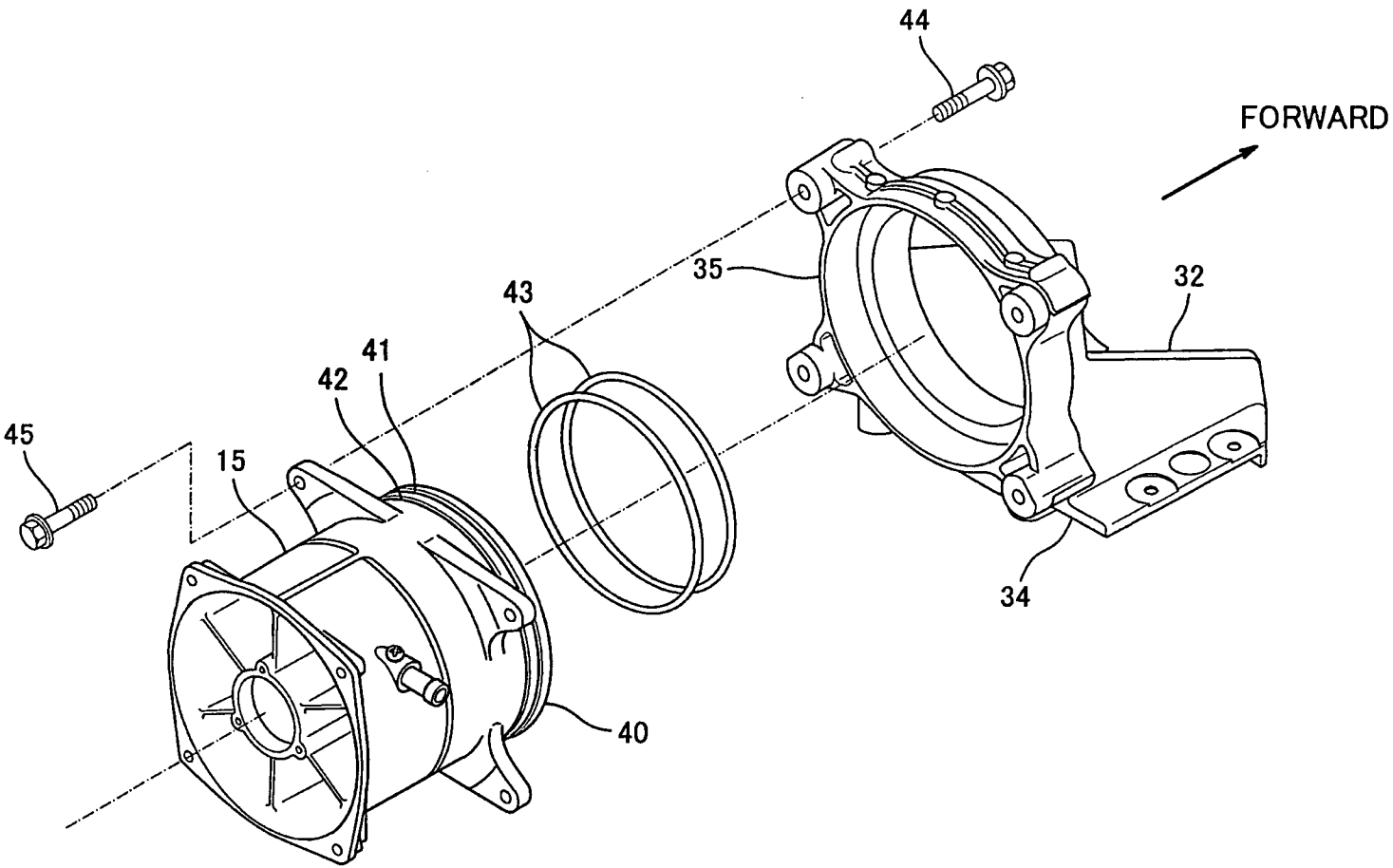
FIG. 5 is an exploded perspective view showing a condition before mounting the pump casing to the pump bracket.
Figure 6A:
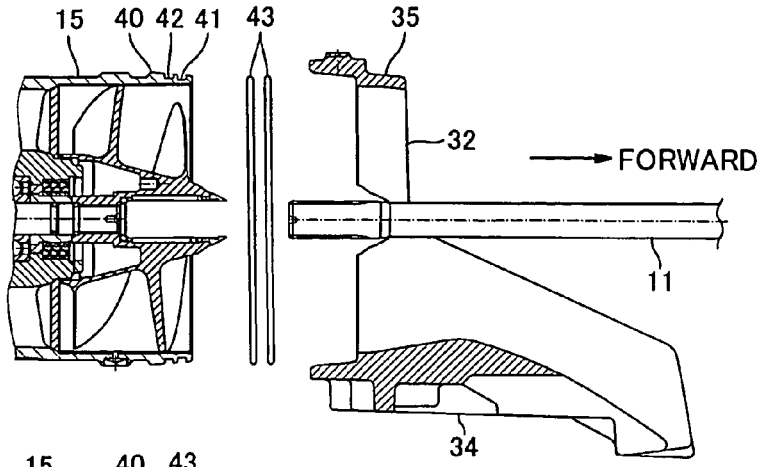
FIG. 6A is a side cross-sectional view showing a condition before mounting the pump casing to the pump bracket.
Figure 6B:
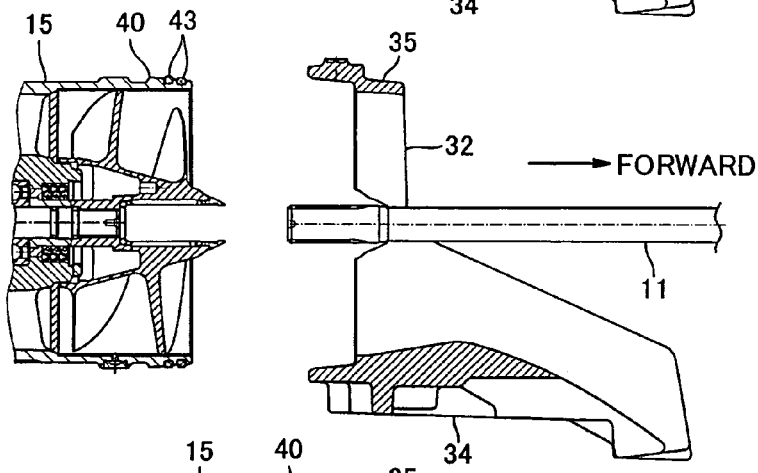
FIG. 6B is a side cross-sectional view showing a state in which seal elements are attached to the pump casing.
Figure 6C:
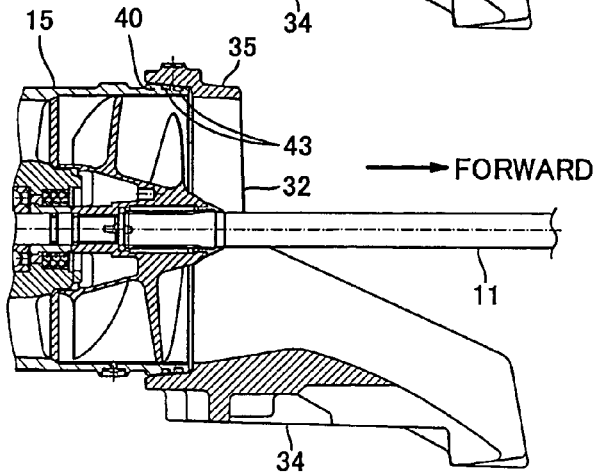
FIG. 6C is a side cross-sectional view showing a state in which the pump casing is mounted to the pump bracket.

FIG. 5 is an exploded perspective view showing a state before mounting the pump casing 15 to the pump bracket 32. FIGS. 6A to 6C are side cross-sectional views showing a procedure by which the pump casing 15 is mounted to the pump bracket 32. Before the pump casing 15 is mounted to the pump bracket 32 as shown in FIGS. 5 and 6A, the pump bracket 32 is fastened to the front wall of the pump room PR formed on the hull 2 by using mounting bolts 44, and the seal elements 43 are externally fitted into the grooves 41 and 42 of the internal fitting portion 40 of the pump casing 15 (see FIG. 6B). Then, the pump casing 15 with the seal elements 43 is moved close to the casing receiving portion 35 of the pump bracket 32 from rearward (see arrow of FIG. 6B), thereby causing the internal fitting portion 40 to be internally fitted to the inner peripheral surface 35*a* of the casing receiving portion 35 (FIG. 6C). Then, using mounting bolts 45 of FIG. 5, the pump casing 15 is firmly fastened to the pump bracket 32.

As shown in FIG. 4, since the internal fitting portion 40 of the pump casing 15 has an outer diameter that decreases forward, i.e., toward the pump bracket 32, and the casing receiving portion 35 of the pump bracket 32 has an inner diameter that increases rearward, i.e., toward the pump casing 15, the internal fitting portion 40 can be easily inserted into the casing receiving portion 35. As a result, although the pump casing 15 is mounted to the pump bracket 32 located in the pump room PR which has a narrow space defined by the hull 2, an operator can easily mount the pump casing 15 to the pump bracket 32 without visually checking these components.

The seal elements 43 fitted into the grooves 41 and 42 are less likely to displace by contact with the pump bracket 32 in insertion. Therefore, the pump casing 15 is reliably mounted to the pump bracket 32 in a highly sealed condition without a need for the operator to visually check these components. In addition, this construction advantageously uses the simple ring-shaped seal elements (O-rings).

Furthermore, since the water jet pump P is of the axial-flow type, the pump casing 15 is mounted to the pump bracket 32 freely in the longitudinal direction. In addition, the outer peripheral surface 40*a* of the internal fitting portion 40 of the pump casing 15 and the inner peripheral surface 35*a* of the casing receiving portion 35 are inclined with respect to the direction in which the pump casing 15 is mounted to the pump bracket 32, and are taper-connected. In such a structure, since the internal fitting portion 40 of the pump casing 15 is inserted into the inside of the casing receiving portion 35 as far as possible toward forward, they may be connected in a highly sealed condition.

The mounting portion of the water jet pump P of the present invention is applicable to a diagonal-flow type water jet pump equipped with a pump casing with an inner diameter that increases rearward, as well as to the axial-flow type water jet pump. While the outer diameter of the internal fitting portion 40 of the pump casing 15 decreases forward and the inner diameter of the casing receiving portion 35 of the pump bracket 32 increases rearward, they may alternatively be configured as described below.

Figure 7:
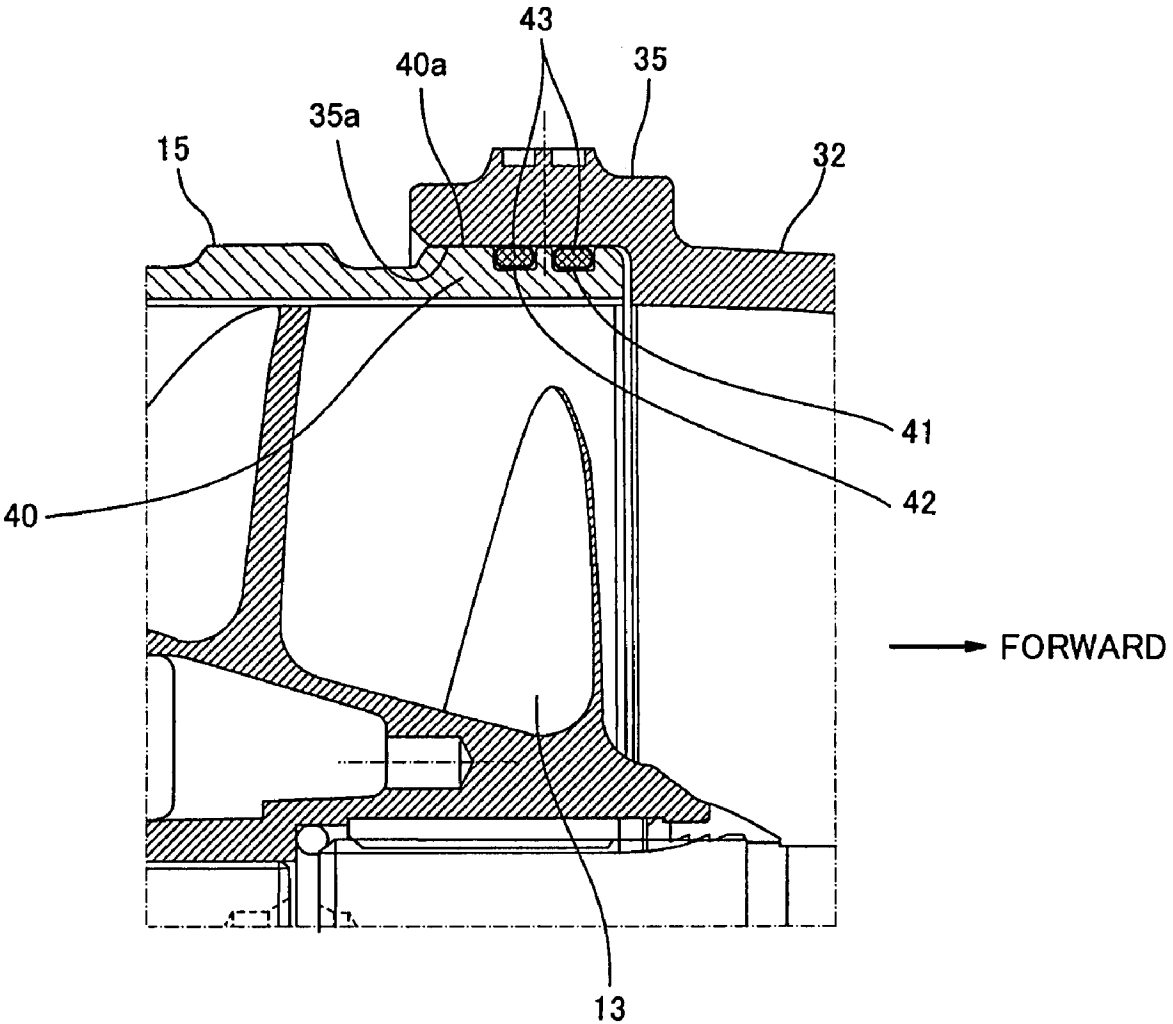
FIG. 7 is a partial enlarged cross-sectional view showing another mounting portion.

FIG. 7 is a partial cross-sectional view showing another mounting portion including the pump casing 15 and the pump bracket 32 configured to fasten the pump casing 15 to the body 1 of the watercraft. As shown in FIG. 7, the internal fitting portion 40 of the pump casing 15 has a substantially constant outer diameter, while the casing receiving portion 35 of the pump bracket 32 has a substantially constant inner diameter which is slightly larger than the outer diameter of the internal fitting portion 40. Since the other components are identical to those of FIGS. 3 and 4, they are identified by the same reference numerals as those in FIGS. 3 and 4 and will not be further described.

In the water jet pump P constructed above, displacement of the seal elements 41 and 42 are inhibited when the pump casing 15 is mounted to the pump bracket 32. They may be highly sealed by the seal elements 41 and 42 having a simple shape.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A mounting portion of a water jet pump of a personal watercraft, the water jet pump including an impeller that rotates to eject water taken in from a bottom of a body of the watercraft rearward to thereby propel the watercraft, the mounting portion comprising:

a tubular pump casing configured to accommodate the impeller; and a pump bracket configured to fasten the pump casing to the body of the watercraft;

wherein the pump casing includes an internal fitting portion in a front portion thereof, and the internal fitting portion is provided on an outer peripheral surface thereof with a plurality of grooves extending concentrically with the pump casing over an entire circumference of the internal fitting portion and is configured to be internally fitted into the pump bracket;

wherein the pump bracket includes a casing receiving portion in a rear portion thereof and is configured to be externally fitted to the internal fitting portion of the pump casing;

wherein the pump casing is configured to be mountable to the pump bracket in such a manner that the internal fitting portion is internally fitted to the casing receiving portion of the pump bracket from rearward with a plurality of ring-shaped seal elements having cross-sectional areas larger than cross-sectional areas of the grooves, fitted into the grooves so as to partially protrude from the outer peripheral surface of the internal fitting portion, and an outer peripheral surface of the internal fitting portion and an inner peripheral surface of the casing receiving portion are sealed by the seal elements; and wherein the internal fitting portion of the pump casing has an outer diameter that decreases forward, and the casing receiving portion of the pump bracket has an inner diameter that increases rearward so as to conform in shape to the outer peripheral surface of the internal fitting portion.

2. The mounting portion of a water jet pump of a personal watercraft according to claim 1, wherein the water jet pump is of an axial-flow type in which the pump casing has a substantially constant inner diameter in an axial direction of the water jet pump.

3. The mounting portion of a water jet pump of a personal watercraft according to claim 1, wherein the seal elements are O-rings having circular cross-sections.

4. The mounting portion of a water jet pump of a personal watercraft according to claim 1, wherein the seal elements are square rings.

5. A water-jet propulsion personal watercraft comprising:

a body including a hull having a water intake and a deck covering the hull from above;

a water jet pump mounted in a pump room formed on a rear bottom portion of the hull and including an impeller that rotates to eject water taken in from the water intake to thereby propel the watercraft;

a water intake passage through which water is guided from the water intake to the water jet pump;

a tubular pump casing configured to accommodate the impeller; and a pump bracket configured to fasten the pump casing to the body and to couple the water intake passage to the pump casing with the pump casing fastened to the body;

wherein the pump casing includes an internal fitting portion in a front portion thereof, and the internal fitting portion is provided on an outer peripheral surface thereof with a plurality of grooves extending concentrically with the pump casing over an entire circumference of the internal fitting portion and is configured to be internally fitted to the pump bracket;

wherein the pump bracket includes a casing receiving portion in a rear portion thereof and is configured to be externally fitted to the internal fitting portion of the pump casing;

wherein the pump casing is configured to be mountable to the pump bracket in such a manner that the internal fitting portion is internally fitted to the casing receiving portion of the pump bracket from rearward with a plurality of ring-shaped seal elements having cross-sectional areas larger than cross-sectional areas of the grooves, fitted into the grooves so as to partially protrude from the outer peripheral surface of the internal fitting portion, and an outer peripheral surface of the internal fitting portion and an inner peripheral surface of the casing receiving portion are sealed by the seal elements; and wherein the internal fitting portion of the pump casing has an outer diameter that decreases forward, and the casing receiving portion of the pump bracket has an inner diameter that increases rearward so as to conform in shape to the outer peripheral surface of the internal fitting portion.

* * * * *